US005502429A

United States Patent [19]

De Jong et al.

[11] Patent Number: 5,502,429

[45] Date of Patent: Mar. 26, 1996

[54] INDUCTIVE DEVICE COMPRISING CONNECTION MEMBERS

[75] Inventors: Erik A. A. De Jong; Jan H. M. Hopmans, both of Tilburg, Netherlands

[73] Assignee: U.S. Philips Corporation, New York, N.Y.

[21] Appl. No.: 386,236

[22] Filed: Feb. 9, 1995

[30] Foreign Application Priority Data

Feb. 15, 1994 [EP] European Pat. Off. ..... 94200393

[51] Int. Cl.[6] ..... H01F 15/10

[52] U.S. Cl. ..... 336/192

[58] Field of Search ..... 336/192, 198, 336/208; 310/71

[56] References Cited

U.S. PATENT DOCUMENTS 2,963,678 12/1960 Woolf et al. ..... 336/192
3,562,903 2/1971 Busler et al. ..... 336/192

FOREIGN PATENT DOCUMENTS 4015564 11/1991 Germany .
1276914 6/1972 United Kingdom ..... 336/192

*Primary Examiner*—Thomas J. Kozma
*Attorney, Agent, or Firm*—Bernard Franzblau

[57] ABSTRACT

An inductive device comprises a coil former made of an electrical insulating material and at least one winding of an electrically conductive wire provided on the coil former. The coil former is provided with connection members which are made of an electrically conductive material and each of which has a fixing portion which is anchored in the coil former, a comparatively rigid attachment pin to which one end of the wire is secured, and a comparatively flexible contact pin which projects from the coil former. The attachment pin and the contact pin extend substantially in parallel and are interconnected by a connection portion which extends approximately transversely of their longitudinal direction. The fixing portion extends substantially as the prolongation of the attachment pin at the side of the connection portion which is remote from the attachment pin and the contact pin. The attachment pin has a cross-section which is larger and a length which is shorter than that of the contact pin.

7 Claims, 1 Drawing Sheet

INDUCTIVE DEVICE COMPRISING CONNECTION MEMBERS

BACKGROUND OF THE INVENTION

This invention relates to an inductive device, comprising a coil former made of an electrically insulating material, and at least one winding of an electrically conductive wire arranged on the coil former, said coil former being provided with connection members which are made of an electrically conductive material and each of which comprises a fixing portion which is anchored in the coil former, a comparatively rigid attachment pin to which one end of the wire is attached, and a comparatively flexible contact pin which projects from the coil former.

A device of this kind is known from DE-A-40 15 564. The connection member of the known device is formed by bending a piece of wire. Because of the comparatively complex shape of the connection member, this is an intricate and hence expensive operation. The fixing portion of the known connection member is situated between the attachment pin and the contact pin, so that in order to secure the connection member in the coil former it is necessary to arrange the fixing portion in a trough recessed in the coil former. Subsequently, the walls of the trough must be distorted by means of a suitable tool so that the fixing portion is locked in the trough. This is also a time-consuming and expensive operation. A third drawback of the known device consists in that the properties of the wire constituting the connection member represent a compromise between the contradictory requirements imposed in respect of the contact pin and the attachment pin. This is because the attachment pin must be comparatively rigid in order to enable the winding wire to be wrapped around this pin without the pin being deformed, whereas the contact pin must be flexible. The latter is necessary because the device will be secured, generally speaking, in a printed circuit board (PCB), the contact pin being soldered into the board. In the event of temperature fluctuations, the PCB will expand and shrink, so that this soldered joint is loaded. If the contact pin is flexible, it can follow these motions so that the soldered joint is loaded substantially less. The wire constituting the connection member evidently has the same thickness over its entire length, so that the flexibility of the contact pin must be achieved by bending the contact pin in a meander-like fashion. Because of this compromise, in many cases the contact pin will be more rigid and the connection pin will be more flexible than desired to achieve an optimum result.

SUMMARY OF THE INVENTION

It is an object of the invention to provide a device of the kind set forth in which the connection member can be simply and inexpensively manufactured and in which the mechanical properties of the contact pin and the attachment pin can be optimized to a high degree, independently of one another. To achieve this, the device in accordance with the invention is characterized in that the attachment pin and the contact pin extend substantially in parallel and are interconnected by a connection portion which extends approximately transversely of their longitudinal direction, that the fixing portion extends substantially as the prolongation of the attachment pin at the side of the connection portion which is remote from the attachment pin and the contact pin, and that the cross-section of the attachment pin is greater than that of the contact pin whereas its length is shorter than that of the contact pin. The cross-sections of the attachment pin and the contact pin can thus be chosen in a highly independent manner, so that the flexibility of each of these parts of the connection member can also be optimally adjusted. The fixing portion now comprises a free end so that it can be readily inserted into an opening recessed for this purpose in the coil former, or can be embedded in the material thereof during the formation of the coil former (for example, by injection moulding). These operations can be quickly and inexpensively performed.

The connection portion contributes to the flexibility of the contact pin. This contribution can be increased by constructing the connection portion so as to have a cross-section which is smaller than that of the attachment pin.

The flexibility of the contact pin can be further increased by making the contact pin extend in a meander-like fashion over at least a part of its length which is situated near the connection portion.

The manufacture of the connection member is particularly simple and inexpensive when each of the connection members is formed from a single piece of sheet material.

BRIEF DESCRIPTION OF THE DRAWINGS

These and other aspects of the invention will be described in detail hereinafter with reference to the drawing in which.

DESCRIPTION OF THE PREFERRED EMBODIMENTS

Figure 1:
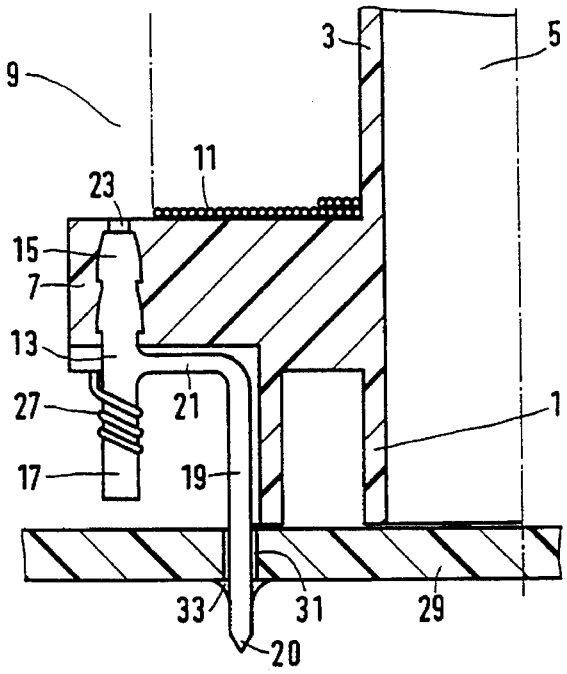
FIG. 1 is a longitudinal sectional view of a part of an embodiment of an inductive device in accordance with the invention.

FIG. 1 shows a part of an inductive device (for example, a coil or a transformer), comprising a coil former 1 which is made of an electrically insulating material. The coil former 1 can be made of a suitable synthetic material in known manner, for example, by injection moulding. The coil former 1 comprises a cylindrical central portion 3 with an internal cavity 5 for accommodating a core of a soft-magnetic material (not shown). At both ends of the central portion 3 there are formed flanges 7, one of which is shown in FIG. 1. The flanges 7 bound a winding space 9 in which one or more windings 11 of an electrically conductive wire, for example, copper wire provided with a suitable insulating sheath, are accommodated.

Figure 2:
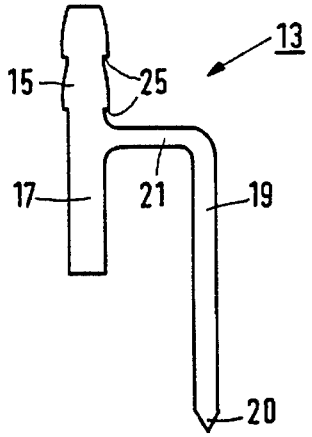
FIG. 2 is a side elevation of a first embodiment of a connection member for the device shown in FIG. 1.

The coil former 1 also comprises a number of connection members 13, only one of which is visible in FIG. 1. Each of the connection members is formed, preferably by means of a punching operation, from a single piece of electrically conductive sheet material, for example, phosphor bronze or a suitable iron alloy. The connection member 13, which is separately shown in FIG. 2, comprises a fixing portion 15, an attachment pin 17 and a contact pin 19. The free end 20 of the contact pin 19 is pointed so that the contact pin can be readily inserted into an opening. The attachment pin 17 and the contact pin 19 extend substantially in parallel and are interconnected by a connection portion 21 which extends approximately transversely of their longitudinal direction. The fixing portion 15 extends in the prolongation of the attachment pin 17 and is situated to the side of the connection portion 21 which is remote from the attachment pin and the contact pin 19 (the upper side in the FIGS. 1 and 2).

Because connection member is made of a single piece of sheet material, its thickness is the same everywhere, except at the area of the pointed tip 20, said thickness being, for example 0.8 mm. The thickness is the dimension perpendicular to the plane of the drawing. The width of the attachment pin 17 is greater than that of the contact pin 19, so that the cross-section of the attachment pin is also greater than that of the contact pin. The length of the contact pin 19 is substantially greater than that of the attachment pin 17. As a result of these steps, the contact pin 19 is comparatively flexible and the attachment pin 17 is comparatively rigid.

The connection member 13 is firmly secured in the coil former 1 by way of the fixing portion 15. To this end, for example in one of the flanges 7 there is recessed an opening 23 in which the fixing portion 15 can be inserted with some force. The wall of the opening 23 is then slightly deformed, so that the fixing portion 15 is firmly secured in the coil former 1. In order to make fixing even more reliable, the fixing portion 15 may be provided with a suitable profile, for example, in the form of a number of barb-like protrusions 25. It is alternatively possible to embed the fixing portion 15 in the synthetic material during manufacture of the coil former 1.

A free end 27 of the wire constituting the winding 11 is wrapped around the attachment pin 27 and electrically contacts said pin. The wire end 17 may be connected to the attachment pin 17, for example, by way of a so-called wire-wrap or a soldered joint. During wrapping of the wire about the attachment pin 17, comparatively large forces are exerted on the attachment pin. Therefore, it is important that the cross-section of the attachment pin 17 be so large that it can readily withstand these forces without being deformed.

As is shown in FIG. 1, the contact pin 19 serves to secure the device on a printed circuit board (PCB) 29. The PCB 29 is a board of an insulating material on which conductor tracks (not shown) are provided. In the board there are provided openings 31 whose diameter is slightly greater than the width of the contact pins 19. The inductive device is arranged on the PCB 29 so that each of the contact pins 19 projects through one of the openings 31. Subsequently, at the side of the PCB 29 which is remote from the coil former 1 soldered joints 33 are formed between the contact pins 19 and the conductor tracks, for example by wave soldering.

During operation of the apparatus in which the PCB is included, the temperature of the PCB and the inductive device increases. Consequently, these parts expand to a different degree. Upon cooling after switching off of the apparatus, the reverse takes place. If the contact pin 19 were constructed so as to be rigid, comparatively large forces would be exerted on the soldered joints 33 due to such expansion and shrinking, so that cracks could occur in these joints. The joints 33 would then exhibit an increasingly higher electrical resistance, so that they would become ever warmer in response to the passage of current. Ultimately, this could lead to faults in the apparatus and it could even cause a fire. Because the contact pins 19 have a comparatively small cross-section, they are comparatively flexible so that they can readily take up the forces caused by the differences in expansion. Therefore, the soldered joints 33 are not or are only hardly loaded and the reliability and safety of the apparatus are substantially enhanced. The flexibility of the contact pin 19 is further increased in that the width (and hence also the cross-section) of the connection portion 21 is smaller than that of the attachment pin 17.

Figure 3:
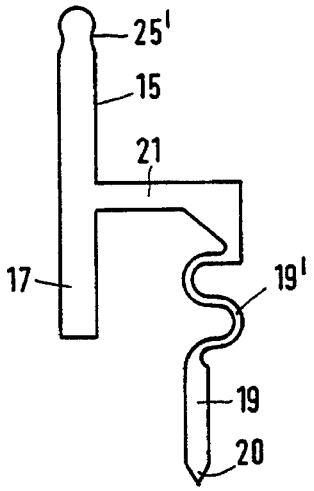
FIG. 3 is a side elevation of a second embodiment of a connection member.

The flexibility of the contact pin 19 is further increased in the embodiment shown in FIG. 3. In this embodiment the contact pin 19 is meander-shaped over a part 19' of its length. The meander-shaped part 19' is situated near the connection portion 21. As a result of the meander-like shape of this part, the effective length of the contact pin 19 is substantially increased so that the contact pin is substantially more flexible without occupying more space. In this embodiment suitable anchoring of the fixing portion 15 to the coil former 1 is achieved in that a constriction 25' is provided near the free end of the fixing portion.

We claim:

1. An inductive device, comprising a coil former made of an electrically insulating material, and at least one winding of an electrically conductive wire arranged on the coil former, said coil former, comprising connection members made of an electrically conductive material and each of which comprises a fixing portion anchored in the coil former, a comparatively rigid attachment pin to which one end of the wire is attached, and a comparatively flexible contact pin which projects from the coil former, wherein the attachment pin and the contact pin extend substantially in parallel and are interconnected by a connection portion which extends approximately transversely of their longitudinal direction the fixing portion extends substantially in the prolongation of the attachment pin at the side of the connection portion which is remote from the attachment pin and the contact pin, and the cross-section of the attachment pin is greater than that of the contact pin whereas its length is shorter than that of the contact pin.

2. A device as claimed in claim 1, wherein the connection portion has a cross-section which is smaller than that of the attachment pin.

3. A device as claimed in claim 1 or 2, wherein the contact pin extends in a meander-like fashion over at least a part of its length which is situated near the connection portion.

4. A device as claimed in claim 3 wherein each of the connection members is formed from a single piece of sheet material.

5. A device as claimed in claim 1, wherein the contact pin extends in a meander-like fashion over at least a part of its length which is situated near the connection portion.

6. A device as claimed in claim 2 wherein each of the connection members is formed from a single piece of sheet material.

7. A device as claimed in claim 1 wherein each of the connection members is formed from a single piece of sheet material.

* * * * *